US008168364B2

(12) United States Patent
Sugiura et al.

(10) Patent No.: US 8,168,364 B2
(45) Date of Patent: May 1, 2012

(54) RESIN-FILLED CARRIER FOR ELECTROPHOTOGRAPHIC DEVELOPER, AND ELECTROPHOTOGRAPHIC DEVELOPER USING THE RESIN-FILLED CARRIER

(75) Inventors: Takao Sugiura, Kashiwa (JP); Takeshi Gondo, Kashiwa (JP); Hiromichi Kobayashi, Nagareyama (JP)

(73) Assignee: Powdertech Co., Ltd., Chiba (JP)

( * ) Notice: Subject to any disclaimer, the term of this patent is extended or adjusted under 35 U.S.C. 154(b) by 242 days.

(21) Appl. No.: 12/403,544

(22) Filed: Mar. 13, 2009

(65) Prior Publication Data

US 2009/0263739 A1 Oct. 22, 2009

(30) Foreign Application Priority Data

Mar. 14, 2008 (JP) ..... 2008-066391
Sep. 3, 2008 (JP) ..... 2008-226084

(51) Int. Cl.
*G03G 9/10* (2006.01)

(52) U.S. Cl. ..... 430/111.32; 430/111.4

(58) Field of Classification Search ..... 430/111.32, 430/111.4
See application file for complete search history.

(56) References Cited

U.S. PATENT DOCUMENTS

| | | | | |
|---|---|---|---|---|
| 7,442,483 | B2 * | 10/2008 | Kobayashi et al. | 430/111.3 |
| 7,521,163 | B2 * | 4/2009 | Uemura et al. | 430/111.32 |
| 7,553,597 | B2 * | 6/2009 | Kobayashi et al. | 430/111.3 |
| 7,566,519 | B2 * | 7/2009 | Kobayashi et al. | 430/111.35 |
| 7,824,833 | B2 * | 11/2010 | Kayamoto et al. | 430/111.1 |
| 2002/0172884 | A1 * | 11/2002 | Kayamoto et al. | 430/111.41 |
| 2002/0177061 | A1 * | 11/2002 | Kobayashi et al. | 430/111.32 |
| 2003/0091923 | A1 * | 5/2003 | Kobayashi et al. | 430/111.33 |
| 2004/0043320 | A1 * | 3/2004 | Naito et al. | 430/111.33 |
| 2004/0229151 | A1 * | 11/2004 | Kobayashi et al. | 430/111.32 |

FOREIGN PATENT DOCUMENTS

| | | |
|---|---|---|
| JP | 54-78137 | 6/1979 |
| JP | 540367 | 2/1993 |
| JP | 11-295933 | 10/1999 |
| JP | 11295935 | 10/1999 |
| JP | 2006-337579 | 12/2006 |
| JP | 2007-57943 | 3/2007 |
| JP | 2007-133100 | 5/2007 |
| JP | 2007-218955 | 8/2007 |

* cited by examiner

*Primary Examiner* — Hoa V Le
(74) *Attorney, Agent, or Firm* — Greenblum & Bernstein, PLC

(57) ABSTRACT

A resin-filled carrier for an electrophotographic developer obtained by filling resin into voids of a porous ferrite core material, wherein the porous ferrite core material has a pore volume of 0.04 to 0.16 mL/g and a peak pore size of 0.9 to 2.0 μm, and an electrophotographic developer using this resin-filled carrier.

20 Claims, No Drawings

RESIN-FILLED CARRIER FOR ELECTROPHOTOGRAPHIC DEVELOPER, AND ELECTROPHOTOGRAPHIC DEVELOPER USING THE RESIN-FILLED CARRIER

BACKGROUND OF THE INVENTION

1. Field of the Invention

The present invention relates to a resin-filled carrier used in a two-component electrophotographic developer used in copiers, printers and the like. More specifically, the present invention relates to a resin-filled carrier for an electrophotographic developer having a lightened true density, a longer life with excellent durability, rapid charge startup properties, and which does not cause charge fluctuation during printing, and an electrophotographic developer using this resin-filled carrier.

2. Description of the Related Art

Electrophotographic developing methods develop by adhering toner particles in a developer to an electrostatic latent image which is formed on a photoreceptor. The developer used in such methods can be classified as either being a two-component developer composed of toner particles and carrier particles, or a one-component developer which only uses toner particles.

Among such developers, as a developing method using a two-component developer composed of toner particles and carrier particles, a cascade method or the like has long been employed. However, currently magnetic brush methods using a magnet roll have become mainstream.

In a two-component developer, carrier particles act as a carrying substance for imparting the desired charge to the toner particles and transporting the toner particles thus-imparted with a charge to the surface of the photoreceptor to form a toner image on the photoreceptor by stirring the carrier particles with the toner particles in a developing box which is filled with the developer. Carrier particles remaining on the developing roll which supports the magnets return back into the developing box from this developing roll, and are then mixed and stirred with new toner particles for reuse over a certain time period.

Unlike one-component developers, in two-component developers the carrier particles are mixed and stirred with the toner particles to charge the toner particles. The carrier particles also have a transporting function and are easily controlled when designing the developer. Therefore, two-component developers are suitable for full color developing apparatuses in which high image quality is demanded and for apparatuses performing high-speed printing in which the reliability and durability of image sustainability are demanded.

In two-component developers which are used in such a manner, the image properties, such as image density, fogging, white spots, gradation and resolution, need to exhibit a certain value from the initial stage. Furthermore, these properties must not change during printing and have to be stably maintained. To stably maintain these properties, it is necessary for the properties of the carrier particles in the two-component developer to be stable.

Conventionally, various kinds of carrier, such as an iron powder carrier, a ferrite carrier, a resin-coated ferrite carrier, a magnetic powder-dispersed resin carrier and the like, have been used for the carrier particles forming a two-component developer.

In recent years the workplace has become more networked, evolving from an era of single-function copiers to multifunction devices. In addition, the type of service provided has shifted from a system in which a contracted repair worker carries out regular maintenance and replaces the developer and other parts to a maintenance-free system. Further, demands from the market for even longer developer life are becoming much greater.

In view of these circumstances, Japanese Patent Laid-Open No. 5-40367 proposes many magnetic powder-dispersed carriers in which fine, magnetic microparticles are dispersed in a resin to extend developer life by making the carrier particles lighter.

Such a magnetic powder-dispersed carrier can reduce true density by reducing the amount of magnetic microparticles, thus reducing the stress from stirring. As a result, chipping or peeling of the coating can be prevented, whereby stable image properties for a long period of time can be obtained.

However, because a binder resin covers the magnetic microparticles, the magnetic powder-dispersed carrier has a high carrier resistance. Thus, there is the drawback that it is difficult to obtain sufficient image density.

In addition, since the magnetic microparticles are hardened by the binder resin, the magnetic powder-dispersed carrier has also had the drawbacks that the magnetic microparticles detach due to stirring stress or from shocks in the developing apparatus, and that the carrier particles themselves split, possibly as a result of having inferior mechanical strength as compared with the conventionally-used iron powder carrier or ferrite carrier. The detached magnetic microparticles or split carrier particles adhere to the photoreceptor, thereby becoming a factor in causing image defects.

Further, a magnetic powder-dispersed carrier has the drawback that since fine magnetic microparticles are used, remnant magnetization and coercive force increase, so that the fluidity of the developer deteriorates. Especially when a magnetic brush is formed on a magnet roll, the bristles of the magnetic brush stiffen due to the presence of remnant magnetization and coercive force, which makes it difficult to obtain high image quality. There is also the problem that even when the carrier leaves the magnet roll, because the carrier magnetic agglomerations do not come unloose and the carrier cannot be rapidly mixed with the supplied toner, the rise in the charge amount is poor, which causes image defects such as toner scattering and fogging.

In addition, while a magnetic powder-dispersed carrier can be produced by two methods, crushing or polymerization, the crushing method has a poor yield, and the polymerization method has a complicated production process. Thus, both methods have the problem of high costs.

A resin-filled carrier in which the voids in a porous carrier core material are filled with a resin has been proposed as a replacement for magnetic powder-dispersed carriers. For example, Japanese Patent Laid-Open No. 11-295933 and Japanese Patent Laid-Open No. 11-295935 disclose a carrier which comprises soft-magnetic cores or hard magnetic cores, a polymer contained in the pores of the cores, and a coating which covers the cores. These resin-filled carriers enable a carrier to be obtained having few shocks, a desired fluidity, a broad range of frictional charge values, a desired conductance and a volume average particle size that is within a certain range.

Japanese Patent Laid-Open No. 11-295933 discloses that various suitable porous solid core carrier substances, such as a known porous core, may be used as the core material. Japanese Patent Laid-Open No. 11-295933 states that it is especially important that the carrier is porous and has the desired fluidity, and that soft magnetism, porosity as represented by BET surface area and volume average particle size are properties which need to be given attention.

However, as is described in the examples of Japanese Patent Laid-Open No. 11-295933, for a porosity of about 1,600 $cm^2/g$ in BET surface area, a sufficient reduction in the specific gravity is not achieved even by filling with a resin, and thus such a carrier cannot cope with the recent ever increasing demands for lengthened developer life.

Japanese Patent Laid-Open No. 11-295933 also discloses that it is difficult to precisely control the specific gravity and mechanical strength of a carrier which has been filled with resin merely by controlling the porosity as represented by BET surface area.

The measurement principle of BET surface area is to measure the physical and chemical adsorption of a specific gas, which does not correlate with the porosity of the core material. In other words, it is typical for BET surface area to change depending on particle size, particle size distribution and nature of the surface material even for a core material that has hardly any pores. Thus, even if porosity is controlled using the BET surface area measured in the above-described manner, it cannot be said that the core material can be sufficiently filled with resin. If a large amount of resin is filled into a core material having a high BET surface area value but which is not porous, or into a core material which is not sufficiently porous, the resin which could not be filled remains by itself without closely adhering to the core material. In such a state, the left-over resin floats in the carrier, causing a large amount of agglomerates to form among the particles, whereby fluidity deteriorates. When agglomerates break apart during toner usage, charge properties fluctuate greatly, making it difficult to obtain stable properties.

Further, in Japanese Patent Laid-Open No. 11-295933, a porous core is used, and the total content of the resin filled in the cores and the resin which coats the surface of the cores is preferably about 0.5 to 10% by weight of the carrier. In the examples of Japanese Patent Laid-Open No. 11-295933, the greatest total content of the resins does not even reach 6% by weight of the carrier. With such a small amount of resin, the desired low specific gravity cannot be realized, meaning that a performance that is merely approximate to that of the conventionally used resin-coated carrier is obtained.

Japanese Patent Laid-Open No. 54-78137 discloses a carrier for an electrostatic image developer in which the pores and recesses on the surface of magnetic particles, which are either porous having a bulk specific gravity that is smaller than that of a substantially non-porous substance, or which have a large surface roughness, are filled with a fine powder consisting of an electrical insulating resin.

Japanese Patent Laid-Open No. 2006-337579 proposes a resin-filled carrier formed by filling a resin in a ferrite core material having a void fraction of 10 to 60%. Japanese Patent Laid-Open No. 2007-57943 proposes a resin-filled carrier which has a three-dimensional layered structure. Japanese Patent Laid-Open Nos. 2006-337579 and 2007-57943 disclose that various methods may be employed for filling the resin in the resin-filled carrier core material, such as a dry method, a spray-dry method using a fluidized bed, a rotary-dry method, and a liquid immersion-dry method using a universal stirrer, and that a suitable method is selected according to the core material and resin to be used.

Further, Japanese Patent Laid-Open No. 2007-57943 discloses that when filling the resin, since it is difficult to fill the voids with resin under an ordinary pressure or in a pressurized state, it is preferred to reduce the pressure inside the filling apparatus, so that the resin can be efficiently and sufficiently filled in the voids inside the particles, which makes it easier to form a three-dimensional layered structure.

Further, Japanese Patent Laid-Open No. 2007-133100 discloses a carrier in which a resin is impregnated in a porous magnetic body, and a carrier coated with a large amount of resin on the surface of a core material. Since these carriers have a light true specific gravity, excess carrier can be smoothly discharged along with the toner by developing while supplying a supply developer having the toner and carrier to the developing apparatus, and as necessary using the carrier which is in excess in the developing apparatus interior in a two-component developing method supply developer which is discharged from the developing apparatus.

There are examples of the porous magnetic powder described in Japanese Patent Laid-Open Nos. 2006-337579, 2007-57943, 2007-133100 in which void volume of the core material is investigated by BET and oil absorption. However, BET only relates to surface area, and the actual level of voids cannot be found from the BET value. Further, while oil absorption does reflect void volume to a certain extent, considering oil absorption measurement principles, the gaps between the particles are also measured together with the voids in the particles, and thus oil absorption does not measure the actual void volume. Further, the gaps between the particles are usually larger than the actual void volume in the particles, so that oil absorption lacks accuracy as an index when trying to fill resin without any excess. Further, since Japanese Patent Laid-Open Nos. 2006-337579, 2007-57943, 2007-133100 do not describe the diameter of the voids which are present on the ferrite surface in which the resin is to be filled, or the distribution of such void diameters, when the resin is actually filled, there is filled resin unevenness among the particles and a lack of uniformity in resin filling. As a result, the particles which are not sufficiently filled with resin have poor strength, so that the carrier particles split and microparticles form during use in an actual machine, which are factors in image defects.

Japanese Patent Laid-Open No. 2007-218955 describes the pore size and pore volume of core material particles. Specifically, Japanese Patent Laid-Open No. 2007-218955 discloses that by providing, at the stage of the carrier core material prior to resin filling, durability capable of maintaining high resistance under high-voltage application conditions, maintenance of high-resistance during high-voltage application at the point when the carrier is used as an electrophotographic developer can be markedly improved, so that prevention of breakdown and prevention of a deterioration in image properties can be achieved. Further, Japanese Patent Laid-Open No. 2007-218955 discloses that for anti-spent properties as well, it is important to produce a porous magnetic powdered body having specific pore distribution properties, and to obtain a carrier core material by subjecting this porous magnetic powdered body to a treatment conferring high resistance.

However, in the above-described resin-filled carrier, due to the reduced specific gravity achieved by the resin filling, the stress with the toner is weak. Although this does have the advantage that toner spent is excellent, on the other hand there is the drawback that charge startup is especially slow because sufficient stress with the toner cannot be obtained.

Further, when filling the resin in the porous core material, agglomerations tend to form among the particles. In the carrier particles filled with resin, many agglomerated particles and deformed particles are present. These agglomerated particles break up from the stress during printing, which becomes a factor in causing charge fluctuation.

Further, if the porosity (pore volume and pore size) of the porous core material is increased to facilitate resin filling, the shape of the particles themselves deteriorates, so that deformed particles tend to form. Such deformed particles formed as a result of the porous core material mean that the carrier strength is weak, so that as a result of the stress during printing, the carrier particles themselves split, which becomes a factor in causing charge fluctuation.

Thus, there is a need for a resin-filled carrier for an electrophotographic developer which, while maintaining the advantages of the above-described resin-filled carriers, has rapid charge startup properties, and does not cause charge fluctuation during printing.

SUMMARY OF THE INVENTION

Therefore, it is an object of the present invention to provide a resin-filled carrier for an electrophotographic developer which, while maintaining the advantages of the above-described resin-filled carriers, has rapid charge startup properties, and does not cause charge fluctuation during printing, and an electrophotographic developer using this resin-filled carrier.

As a result of extensive studies into resolving the above-described problems, the present inventors discovered that one of the causes of the deterioration of charge startup properties and of the occurrence of charge fluctuation during printing is that peak pore size is not in a suitable range. Specifically, pore volume, which represents the volume in which the filled resin can be impregnated, must obviously be in a certain range in order to achieve a reduction in specific gravity. Further, pore size, which represents the size of the holes on the surface of the core material which are impregnated with the filled resin, on the other hand also represents the level of indents on the surface of the core material particles. If the pore size is small, the level of indents of this surface decreases, while if the pore size is large, the level of indents of the surface increases. Since the indents on the surface of the particles produce stress during frictional charging with the toner, the level of indents has a close relationship to the charging capability of the carrier particles, specifically, the charge startup properties. Therefore, the larger the pore size becomes, the larger the level of indents on the surface of the particles becomes, so that the charge startup properties of the carrier particles improve. However, if the pore size becomes too large and goes beyond a certain range, agglomerations tend to form among the particles when filling the resin, and many agglomerated particles and deformed particles are formed. Further, an increase in pore size indicates that the shape of the particles themselves has deteriorated, and that such particles also are weaker. Thus, the presence of agglomerated particles and deformed particles as a consequence of the size of the pore size is a factor in charge fluctuation during printing. Accordingly, the present inventors discovered that by setting the pore volume and peak pore size of a porous ferrite core material in a certain specific range, the above-described problems can be resolved, thereby arriving at the present invention.

Specifically, the present invention provides a resin-filled carrier for an electrophotographic developer obtained by filling resin into voids of a porous ferrite core material, wherein the porous ferrite core material has a pore volume of 0.04 to 0.16 mL/g and a peak pore size of 0.9 to 2.0 μm.

In the resin-filled carrier for an electrophotographic developer according to the present invention, in the pore size distribution of the porous ferrite core material, pore size unevenness dv represented by the following formula (1) is preferably 1.5 or less, $$dv=|d_{84}-d_{16}|/2 \quad (1)$$

wherein $d_{16}$ is a pore size calculated from the applied pressure on mercury when the mercury pressure penetration reaches 16%, where the total pressure penetration in the high pressure region is 100%; and $d_{84}$ is a pore size calculated from the applied pressure on mercury when the mercury pressure penetration reaches 84%, in which the total pressure penetration in the high pressure region is 100%.

In the resin-filled carrier for an electrophotographic developer according to the present invention, the resin is filled in the porous ferrite core material preferably in an amount of 6 to 30 parts by weight based on 100 parts by weight of the porous ferrite core material.

The resin-filled carrier for an electrophotographic developer according to the present invention preferably has an average particle size of 20 to 60 μm.

The resin-filled carrier for an electrophotographic developer according to the present invention preferably has a saturated magnetization of 30 to 80 $Am^2/kg$.

The resin-filled carrier for an electrophotographic developer according to the present invention preferably has a pyconometer density of 2.5 to 4.5 $g/cm^3$.

The resin-filled carrier for an electrophotographic developer according to the present invention preferably has an apparent density of 1.0 to 2.5 $g/cm^3$.

Further, the present invention provides an electrophotographic developer composed of the above-described resin-filled carrier and a toner.

The electrophotographic developer according to the present invention may also be used as a supply developer.

Since the resin-filled carrier for an electrophotographic developer according to the present invention is lighter due to a low true density, durability is excellent, a longer life can be achieved. Further, the inventive resin-filled carrier is stronger than a magnetic powder-dispersed carrier, and yet does not split, deform or melt from heat or shocks. In addition, since the inventive resin-filled carrier has a specific pore size and pore volume, charge startup properties are rapid, and charge fluctuation during printing can be prevented.

DETAILED DESCRIPTION OF THE PREFERRED EMBODIMENTS

Preferred embodiments for carrying out the present invention will now be described.

<Resin-Filled Carrier for an Electrophotographic Developer According to the Present Invention>

The resin-filled carrier for an electrophotographic developer according to the present invention is obtained by filling a resin in the voids of a porous ferrite core material. This porous ferrite core material preferably includes at least one selected from the group consisting of Mn, Mg, Li, Ca, Sr, Cu and Zn. Considering the recent trend towards reducing environmental burden, such as restrictions on waste products, it is preferable for the heavy metals Cu, Zn and Ni to be contained in an amount which does not exceed the scope of unavoidable impurities (accompanying impurities).

This porous ferrite core material must have a pore volume of 0.04 to 0.16 mL/g, and a peak pore size of 0.9 to 2.0 μm.

If the pore volume of the porous ferrite core material is less than 0.04 mL/g, a reduction in weight cannot be achieved as a sufficient amount of resin cannot be filled. Further, if the pore volume is more than 0.16 mL/g, the carrier strength cannot be maintained even if the resin is filled. Further, a preferred range for the pore volume of the porous ferrite core material is 0.05 to 0.14 mL/g, and more preferred is 0.06 to 0.12 mL/g.

If the peak pore size of the porous ferrite core material is 0.9 μm or more, because the size of the indents on the core material surface is a suitable size, the contact surface area with the toner increases, and the frictional charging with the toner can be efficiently carried out. As a result, while having a low specific gravity, the charge startup properties improve. If the peak pore size of the porous ferrite core material is less than 0.9 μm, such effects are not obtained. Further, since the carrier surface after filling is smooth, for a carrier having a low specific gravity, sufficient stress with the toner cannot be imparted, so that the charge startup properties deteriorate. In addition, if the peak pore size of the porous ferrite core material is more than 2.0 μm, the area where the resin is present with respect to the surface area of the particles increases, so that when filling the resin, agglomerations tend to form among the particles. As a result, many agglomerated particles and deformed particles are present in the carrier particles which have been filled with resin. These agglomerated particles break up from the stress during printing, which becomes a factor in causing charge fluctuation. Further, a porous core material having such a peak pore size of more than 2.0 μm indicates that the indents on the core material surface are large, which means that the shape of the particles themselves is poor. Moreover, since these particles also have poor mechanical strength, the carrier particles themselves split from the stress during printing, which becomes a factor in causing charge fluctuation. Further, a preferred range for the peak pore size of the porous ferrite core material is 1.0 to 1.6 μm.

Thus, resin-filled carrier with a suitably reduced weight can be obtained by setting the pore volume and the peak pore size in the above-described ranges, without the above-described various problems.

(Pore Size and Pore Volume of the Porous Ferrite Core Material)

Measurement of the pore size and the pore volume of this porous ferrite core material may be carried out in the following manner. Specifically, measurement was carried out using the mercury porosimeters Pascal 140 and Pascal 240 (manufactured by Thermo Fisher Scientific). Using a CD3P (for powdered bodies) as a dilatometer, a sample was placed in a commercially-available capsule made from gelatin which had a plurality of opened holes, and this capsule was then placed in the dilatometer. After evacuating with the Pascal 140, mercury was filled therein. The low pressure region (0 to 400 kPa) was measured, and the results were taken as the first run. Next, evacuation and measurement of the low pressure region (0 to 400 kPa) were again carried out, and the results were taken as the second run. After the second run, the combined weight of the dilatometer, the mercury, the capsule, and the sample was measured. Next, the high pressure region (0.1 MPa to 200 MPa) was measured using the Pascal 240. Using the mercury pressure penetration obtained by the measurement of this high pressure portion, the pore volume, pore size distribution, and peak pore size of the porous ferrite core material were determined. Further, when determining the pore size, the surface tension of the mercury was calculated as 480 dyn/cm and the contact angle as 141.3°.

In the resin-filled carrier for an electrophotographic developer according to the present invention, in the pore size distribution of the porous ferrite core material, the pore size unevenness dv is preferably 1.5 or less, and more preferably 0.9 or less. Here, letting the total mercury pressure penetration in the high pressure region be 100%, the pore size calculated from the applied pressure on mercury when the mercury pressure penetration reaches 84% is given as $d_{84}$, and the pore size calculated from the applied pressure on mercury when the mercury pressure penetration reaches 16% is given as $d_{16}$. Further, the dv value was calculated from the following equation (1).

$$dv=|d_{84}-d_{16}|/2 \quad (1)$$

If the pore size unevenness dv of the porous ferrite core material is more than 1.5, this means that the indents among the particles and the unevenness of the core material shape increase. Therefore, if the dv value exceeds a desired range, unevenness among the particles tends to occur regarding charge startup, charge fluctuation, the shape of the particles and agglomeration due to filling.

The resin-filled carrier for an electrophotographic developer according to the present invention has a resin filled in a porous ferrite core material. The filled amount of resin is, based on 100 parts by weight of the porous ferrite core material, preferably 6 to 30 parts by weight, more preferably 6 to 20 parts by weight, even more preferably 7 to 18 parts by weight, and most preferably 8 to 17 parts by weight. If the filled amount of resin is less than 6 parts by weight, a sufficient reduction in weight cannot be achieved, while if the filled amount of resin is more than 30 parts by weight, agglomerated particles tend to form during filling, which becomes a factor in charge fluctuation.

The resin to be filled is not especially limited, and may be appropriately selected according to the combined toner, the used environment and the like. Examples include a fluororesin, acrylic resin, epoxy resin, polyamide resin, polyamideimide resin, polyester resin, unsaturated polyester resin, urea resin, melamine resin, alkyd resin, phenol resin, fluoroacrylic resin, acryl-styrene resin, silicone resin, and a modified silicone resin modified by an acrylic resin, polyester resin, epoxy resin, polyamide resin, polyamideimide resin, alkyd resin, urethane resin, fluororesin or the like. Taking into consideration detachment of the resin due to mechanical stress during use, a thermosetting resin is preferably used. Specific examples of the thermosetting resin include an epoxy resin, phenol resin, silicone resin, unsaturated polyester resin, urea resin, melamine resin, alkyd resin, and a resin containing these.

A conductive agent may be added to the filled resin in order to control the electrical resistance of the carrier and the charge amount and charge speed. Since the electrical resistance of the conductive agent is itself low, there is a tendency for a charge leak to suddenly occur if the added amount is too large. Therefore, the added amount is 0.25 to 20.0% by weight, preferably 0.5 to 15.0% by weight and especially preferably 1.0 to 10.0% by weight, of the solid content of the filled resin. Examples of the conductive agent include conductive carbon, oxides such as titanium oxide and tin oxide, and various organic conductive agents.

In the filled resin, a charge control agent can be contained. Examples of the charge control agent include various charge control agents generally used for toners and various silane coupling agents. This is because, although the charging capability is sometimes reduced if a large amount of resin is filled, it can be controlled by adding a charge control agent or a silane coupling agent. The charge control agents and coupling agents which may be used are not especially limited. Preferable examples of the charge control agent include a nigrosin dye, quaternary ammonium salt, organic metal complex and metal-containing monoazo dye. Preferable examples of the silane coupling agent include an aminosilane coupling agent and fluorinated silane coupling agent.

The resin-filled carrier for an electrophotographic developer according to the present invention is preferably surface-coated with a coating resin. Carrier properties, and especially electrical properties such as charge properties, are often affected by the materials present on the carrier surface and the shape of the carrier surface. Therefore, by coating the surface with a suitable resin, the desired carrier properties can be adjusted with good precision.

The coating resin is not especially limited. Examples include a fluororesin, acrylic resin, epoxy resin, polyamide resin, polyamideimide resin, polyester resin, unsaturated polyester resin, urea resin, melamine resin, alkyd resin, phenol resin, fluoroacrylic resin, acryl-styrene resin, silicone resin, and a modified silicone resin modified by an acrylic resin, polyester resin, epoxy resin, polyamide resin, polyamideimide resin, alkyd resin, urethane resin, fluororesin or the like. Taking into consideration detachment of the resin due to mechanical stress during use, a thermosetting resin is preferably used. Specific examples of the thermosetting resin include an epoxy resin, phenol resin, silicone resin, unsaturated polyester resin, urea resin, melamine resin, alkyd resin, and a resin containing these. The coated amount of the resin is preferably 0.5 to 5.0 parts by weight based on 100 parts by weight of the filled carrier (before resin coating).

A conductive agent and a charge control agent may be added to such coating resins for the same purpose as described above. The kind and added amount of the conductive agent and charge control agent are the same as for the case of the above-described filled resin.

The resin-filled carrier for an electrophotographic developer according to the present invention preferably has an average particle size of 20 to 60 μm. Within this range, carrier adhesion can be prevented and good image quality can be obtained. If the average particle size is less than 20 μm, this becomes a factor in carrier adhesion, and thus is not preferable. Further, if the average particle size is more than 60 μm, this becomes a factor in image quality deterioration due to a deteriorating charging capability, and thus is not preferable.

(Average Particle Size (Microtrac))

The average particle size was measured using a Microtrac Particle Size Analyzer (Model: 9320-X100), manufactured by Nikkiso Co., Ltd. Water was used for the dispersing solvent. A 100 mL beaker was charged with 10 g of a sample and 80 mL of water, and then 2 to 3 drops of a dispersant (sodium hexametaphosphate) were added therein. Next, using the ultrasonic homogenizer (Model: UH-150, manufactured by SMT Co. Ltd.), the output was set to level 4, and dispersing was carried out for 20 seconds. Then, the bubbles formed on the surface of the beaker were removed, and the sample was charged into the analyzer.

The resin-filled carrier for an electrophotographic developer according to the present invention preferably has a saturated magnetization of 30 to 80 $Am^2/kg$. If the saturated magnetization is less than 30 $Am^2/kg$, this is a factor in carrier adhesion, and thus is not preferable. If the saturated magnetization is more than 80 $Am^2/kg$, the bristles of the magnetic brush stiffen, which makes it difficult to obtain good image quality.

(Saturated Magnetization)

Here, saturated magnetization may was measured using an integral-type B-H tracer BHU-60 (manufactured by Riken Denshi Co., Ltd.). An H coil for measuring magnetic field and a 4 πI coil for measuring magnetization were placed in between electromagnets. In this case, the sample was put in the 4 πI coil. The outputs of the H coil and the 4 πI coil when the magnetic field H was changed by changing the current of the electromagnets were each integrated; and with the H output as the X-axis and the 4 πI coil output as the Y-axis, a hysteresis loop was drawn on recording paper. The measuring conditions were a sample filling quantity of about 1 g, the sample filling cell had an inner diameter of 7 mm±0.02 mm and a height of 10 mm±0.1 mm, and the 4 πI coil had a winding number of 30.

The pyconometer density of the resin-filled carrier for an electrophotographic developer according to the present invention is preferably 2.5 to 4.5 $g/cm^3$. If the pyconometer density is less than 2.5 $g/cm^3$, the carrier has too light a weight, so that charging capability tends to deteriorate. Further, if the pyconometer density is more than 4.5 $g/cm^3$, the carrier weight reduction is insufficient, so that durability is poor.

(Pyconometer Density)

Pyconometer density was measured in the following manner. Specifically, measurement was carried out based on JIS R9301-2-1, using a pyconometer. Here, methanol was used as the solvent, and measurement was carried out at a temperature of 25° C.

The resin-filled carrier for an electrophotographic developer according to the present invention preferably has an apparent density of 1.0 to 2.5 $g/cm^3$. If the apparent density is less than 1.0 $g/cm^3$, the carrier has too light a weight, so that charging capability tends to deteriorate. Further, if the apparent density is more than 2.5 $g/cm^3$, the carrier weight reduction is insufficient, so that durability is poor.

(Apparent Density)

The apparent density was measured according to JIS Z2504 (Apparent density test method for metal powders).

The charge amount of the resin-filled carrier for an electrophotographic developer according to the present invention is preferably an amount so that its startup speed is rapid. The startup speed of the charge amount is measured according to the following method. Here, a general guide for the charge startup speed is as follows.

Less than 80%: A level which cannot withstand use, because image defects, such as toner scattering and fogging, occur since the charge amount during toner supply does not rapidly startup.

80% or more to less than 90%: A level which can barely withstand use, because a few image defects, such as toner scattering and fogging, occur since the charge amount during toner supply does not rapidly startup.

90% or more to less than 95%: A good level in which no image defects, such as toner scattering and fogging, are seen since the charge amount during toner supply sufficiently starts up.

95% or more: A very good level in which absolutely no image defects, such as toner scattering and fogging, are seen since the charge amount during toner supply rapidly starts up.

(Charge Amount Startup Speed)

Using a commercially-available negative toner used in full-color printers (cyan toner for DocuPrint C3530, manufactured by Fuji Xerox Co., Ltd.), the toner concentration was adjusted to 5% by weight (toner weight=1.5 g, carrier weight=38.5 g). The toner-concentration-adjusted developer was placed into a 50 cc glass bottle and then stirred at a speed of 100 rpm. Stirring was carried out for 3 minutes and for 30 minutes, and the respective charge amounts were determined by measuring with a suction type charge amount measurement apparatus (Epping q/m-meter, manufactured by PES-Laboratoriumu). Here, the charge amount startup speed is calculated by the following formula. In this formula, the closer the value is to 100%, the faster the charge amount startup speed is.

Charge Amount Startup Speed (%)=[(Charge Amount After 3 Minutes)/(Charge Amount After 30 Minutes)]×100

The charge fluctuation of the resin-filled carrier for an electrophotographic developer according to the present invention is measured according to the following method. Here, a general guide for the charge fluctuation is as follows.

Less than 80%: A level which cannot withstand use, because image defects, such as toner scattering and fogging, occur since wide charge fluctuation is expected during printing.

80% or more to less than 90%: A level which can barely withstand use, because a few image defects, such as toner scattering and fogging, occur since charge fluctuation is expected during printing.

90% or more to less than 95%: A good level in which no image defects, such as toner scattering and fogging, are seen since only a slight charge fluctuation is expected during printing.

95% or more: A very good level in which absolutely no image defects, such as toner scattering and fogging, are seen since almost no charge fluctuation is expected during printing.

[Charge Fluctuation]

30 g of filled carrier was placed in a 50 cc glass bottle. This glass bottle was put into a cylindrical holder having a diameter of 130 mm and a height of 200 mm, set, and stirring was then carried out for 360 minutes with a tumbler mixer. This carrier and a commercially-available negative toner used in full-color printers (cyan toner for DocuPrint C3530, manufactured by Fuji Xerox Co., Ltd.) were adjusted so that the toner concentration was 5% by weight (toner weight=1.5 g, carrier weight=38.5 g). The toner-concentration-adjusted developer was placed into a 50 cc glass bottle and then stirred at a speed of 100 rpm. Stirring was carried out for 30 minutes, and the charge amount was determined by measuring with a suction type charge amount measurement apparatus (Epping q/m-meter, manufactured by PES-Laboratoriumu). Here, the charge fluctuation is calculated by the following formula. In this formula, the closer the value is to 100%, the lower the charge fluctuation is.

Charge Fluctuation (%)=[(Charge Amount After Stirring for 360 Minutes)/(Charge Amount Before Stirring for 360 Minutes)]×100

The resin-filled carrier for an electrophotographic developer of the present invention preferably has few agglomerated particles and deformed particles. If many agglomerated particles and deformed particles are present, the agglomerated particles break up from the stress during printing, which becomes a factor in causing charge fluctuation. Further, deformed particles formed as a result of the porous core material mean that the carrier strength is weak, so that as a result of the stress during printing, the carrier particles themselves split, which becomes a factor in causing charge fluctuation.

(Evaluation of Particle Shape and Agglomeration Degree)

Evaluation of particle shape and agglomeration degree was carried out by observing the carrier at a magnification of 450 times using a scanning electron microscope (JSM-6100 model, manufactured by JEOL Ltd.).

The evaluation criteria of the shape and agglomeration degree of the carrier particles were as follows.

Cases where hardly any deformed particles and agglomerated particles were observed were evaluated with a "◎", cases where a few deformed particles and agglomerated particles were observed were evaluated with a "○", cases where many deformed particles and agglomerated particles were observed were evaluated with a "Δ", and cases where a very large number of deformed particles and agglomerated particles were observed were evaluated with a "X". Cases with an evaluation of "Δ" or better are considered to be a useable level.

<Method for Producing the Resin-filled Carrier for an Electrophotographic Developer According to the Present Invention>

The method for producing the resin-filled carrier for an electrophotographic developer according to the present invention will now be described.

In the method for producing the resin-filled carrier for an electrophotographic developer according to the present invention, to produce the porous ferrite core material, first, the raw materials are appropriately weighed, and then the resultant mixture is crushed and mixed by a ball mill, vibration mill or the like for 0.5 hours or more, and preferably for 1 to 20 hours. Although the raw materials are not especially limited, it is preferred to select the raw materials so that a composition is formed containing the above-described elements.

The resultant crushed matter is pelletized using a pressure molding machine or the like, and calcined at a temperature of 700 to 1,200° C. This may also be carried out without using a pressure molding machine, by after the crushing adding water to form a slurry, and then granulating using a spray drier. The calcined matter is further crushed by a ball mill, vibration mill or the like, and then charged with water, and optionally with a dispersant, a binder or the like to adjust viscosity. The resultant solution is then granulated by a spray dryer. In the case of crushing after calcination, the calcined matter may be charged with water and crushed by a wet ball mill, wet vibration mill or the like.

The above crushing machine such as the ball mill or vibration mill is not especially limited, but, for uniformly and effectively dispersing the raw materials, preferably uses fine beads having a particle size of 1 mm or less as the media to be used. By adjusting the size, composition and crushing time of the used beads, the crushing degree can be controlled.

Then, sintering is carried out at a temperature of 800 to 1,500° C. in an atmosphere having a controlled oxygen concentration while holding the obtained granulated matter for 1 to 24 hours. At this stage, a rotary electric furnace, a batch-type electric furnace, a continuous electric furnace or the like may be used. The oxygen concentration of the atmosphere during the sintering may be controlled by pumping in an inert gas such as nitrogen, or a reducing gas such as hydrogen or carbon monoxide.

The resultant sintered matter is crushed and classified. The particles are adjusted to a desired size using a conventionally-known classification method, such as air classification, mesh filtration and precipitation.

Thereafter, the electrical resistance can be optionally adjusted by heating the surface at a low temperature to carry out an oxide film treatment. The oxide film treatment may be conducted using a common furnace such as a rotary electric furnace or batch-type electric furnace, and the heat-treatment may be carried out, for example, at 300 to 700° C. The thickness of the oxide film formed by this treatment is preferably 0.1 nm to 5 μm. If the thickness is less than 0.1 nm, the effect of the oxide film layer is small, and thus is not preferable. If the thickness is more than 5 μm, the magnetization may decrease and the resistance may become too high, which makes it difficult to obtain the desired properties, and thus is not preferable. Reduction may optionally be carried out before the oxide film treatment. In this manner, a porous ferrite core material is prepared having a pore volume and a peak pore size in a specific range.

The pore volume, peak pore size, and pore size unevenness of the ferrite core material of such a carrier for an electrophotographic developer may be controlled in various ways, for example according to the kind of raw material to be blended, the crushing degree of the raw materials, whether calcination is carried out, the calcination temperature, the calcination time, the binder amount during granulation by a spray dryer, the sintering method, the sintering temperature, the sintering time, and the sintering atmosphere (e.g., reduction by nitrogen gas, hydrogen gas, carbon monoxide gas etc., or oxidation by oxygen etc.). These control methods are not especially limited. One such example will now be described below.

Specifically, pore volume tends to increase when a hydroxide or a carbonate is used as the kind of raw material to be blended compared with when an oxide is used. Further, pore volume tends to increase if calcining is not carried out, or if the calcination temperature is low, or if the sintering temperature is low or the sintering time is short.

Further, if intermediate sintering is carried out between the sintering and the calcining, the pore volume and peak pore size can be changed since the rate of crystal growth changes.

In addition, by changing the rate of temperature increase or rate of cooling in the sintering, the pore volume and pore size distribution can be changed. If the rate of temperature increase is fast, the pore volume tends to increase, while if the rate of cooling is slow, the pore size distribution tends to become narrower, possibly because the crystal growth becomes more uniform.

Peak pore size tends to decrease by increasing the crushing degree of the used raw materials, especially the raw materials after calcining, to make the crushed primary particles finer. Further, peak pore size can be decreased more during sintering by introducing a reducing gas such as hydrogen or carbon monoxide rather than using an inert gas such as nitrogen.

Further, pore size unevenness can be reduced by increasing the crushing degree of the used raw materials, especially the raw materials after calcining, to make the crushed particle size distribution sharper.

By carrying out these control methods individually or in combination, a porous ferrite core material having a desired pore volume, peak pore size, and pore size unevenness can be obtained.

Resin is filled in the resultant porous ferrite core material. Various methods may be used for the filling method. Examples thereof include a dry method, a spray-dry method using a fluidized bed, a rotary-dry method, and liquid immersion-dry method using a universal stirrer. The resin used here is as described above.

In the above-described step for filling the resin, it is preferred to fill the resin in the voids of the porous ferrite core material while mixing and stirring the porous ferrite core material and the resin to be filled under reduced pressure. By filling the resin under reduced pressure in this manner, the resin can be filled into the voids efficiently. The level of reduced pressure is preferably 10 to 700 mmHg. If the level is more than 700 mmHg, there is no effect of reduced pressure, while if the level is less than 10 mmHg, the resin solution tends to boil during the filling step, making it impossible to carry out the filling efficiently.

It is preferred to divide the above-described step for filling the resin into a plurality of steps. However, it is possible to fill the resin in one filling step, and it is not absolutely necessary to divide this step into a plurality of steps. Nevertheless, when filling a large amount of resin in one attempt, for some resins agglomeration of the particles occurs. If an agglomeration is produced, and this agglomeration is used in a developing apparatus as a carrier, the agglomeration may break apart from the stirring stress of the developing apparatus. Since the charge properties on the surface boundary of the agglomerated particles vary widely, charge variation can occur over time, which is not preferable. In such a case, by dividing up the filling step into a plurality of steps, the filling can be carried out without any excess while preventing agglomeration.

After the resin has been filled, the heated and filled resin may optionally be adhered to the core material by various techniques. The heating may be performed using external heating or internal heating, and may use, for example, a fixed-type or flow-type electric furnace, rotary electric furnace or burner furnace. The heating may even be performed by baking using microwaves. Although the temperature depends on the resin to be filled, a temperature equal to or above the melting point or the glass transition temperature is necessary. For a thermosetting resin, a condensation-crosslinking resin and the like, by increasing the temperature to the point where sufficient curing proceeds, a resin-filled carrier which is strong against shocks can be obtained.

As described above, after the resin is filled in the porous ferrite core material, it is preferred to coat the surface with a resin. Carrier properties, and especially electrical properties such as charge properties, are often affected by the materials present on the carrier surface and the shape of the carrier surface. Therefore, by coating the surface with a suitable resin, the desired carrier properties can be adjusted with good precision. Examples of the coating method include conventionally-known methods, such as brush coating, dry method, spray-dry method using a fluidized bed, rotary-dry method and liquid immersion-dry method using a universal stirrer. To improve the coating efficiency, a method using a fluidized bed is preferable. After coating the resin, baking may be carried out by either external heating or internal heating. The baking can be carried out using, for example, a fixed-type or flow-type electric furnace, rotary electric furnace, burner furnace, or even by using microwaves. In the case of using a UV-curable resin, a UV heater is used. Although the baking temperature depends on the resin which is used, the temperature must be equal to or higher than the melting point or the glass transition point. For a thermosetting resin or a condensation-crosslinking resin, the temperature must be increased to a point where sufficient curing proceeds.

<Electrophotographic Developer According to the Present Invention>

Next, the electrophotographic developer according to the present invention will be described.

The electrophotographic developer according to the present invention is composed of the above-described resin-filled carrier for an electrophotographic developer and a toner.

Examples of the toner particles constituting the electrophotographic developer according to the present invention include crushed toner particles produced by a crushing method, and polymerized toner particles produced by a polymerizing method. In the present invention, toner particles obtained by either method can be used.

The crushed toner particles can be obtained, for example, by thoroughly mixing a binding resin, a charge control agent, and a colorant with a mixer such as a Henschel mixer, then melting and kneading with a twin screw extruder or the like, cooling, crushing, classifying, adding with additives, and then mixing with a mixer or the like.

The binding resin constituting the crushed toner particle is not especially limited, and examples thereof include polystyrene, chloropolystyrene, styrene-chlorostyrene copolymer, styrene-acrylate copolymer and styrene-methacrylate copolymer, as well as a rosin-modified maleic acid resin, epoxide resin, polyester resin and polyurethane resin. These may be used alone or by mixed together.

An arbitrary charge control agent may be used. Examples of a positively-charged toner include a nigrosin dye and a quaternary ammonium salt, and examples of a negatively-charged toner include a metal-containing monoazo dye.

As the colorant (coloring material), conventionally known dyes and pigments can be used. Examples include carbon black, phthalocyanine blue, permanent red, chrome yellow, phthalocyanine green. In addition, additives such as a silica powdered body and titania for improving the fluidity and cohesion resistance of the toner can be added according to the toner particles.

Polymerized toner particles are produced by a conventionally known method such as suspension polymerization, emulsion polymerization, emulsion coagulation, ester extension and phase transition emulsion. The polymerization method toner particles can be obtained, for example, by mixing and stirring a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while stirring and mixing. Then, the polymerized dispersion is charged with a salting-out agent, and the polymerized particles are salted out. The particles obtained by the salting-out are filtered, rinsed and dried to obtain the polymerized toner particles. Subsequently, an additive may optionally be added to the dried toner particles.

Further, during the production of the polymerized toner particles, a fixation improving agent and a charge control agent can be blended in addition to the polymerizable monomer, surfactant, polymerization initiator, and colorant, thereby allowing the various properties of the polymerized toner particles to be to controlled and improved. A chain-transfer agent can also be used to improve the dispersibility of the polymerizable monomer in the aqueous medium and to adjust the molecular weight of the obtained polymer.

The polymerizable monomer used in the production of the above-described polymerized toner particles is not especially limited, and examples thereof include styrene and its derivatives, ethylenic unsaturated monoolefins such as ethylene and propylene, halogenated vinyls such as vinyl chloride, vinyl esters such as vinyl acetate, and α-methylene aliphatic monocarboxylates, such as methyl acrylate, ethyl acrylate, methyl methacrylate, ethyl methacrylate, 2-ethylhexyl methacrylate, dimethylamino acrylate, and diethylamino methacrylate.

As the colorant (coloring material) used for preparing the above polymerized toner particles, conventionally known dyes and pigments are usable. Examples include carbon black, phthalocyanine blue, permanent red, chrome yellow and phthalocyanine green. The surface of colorants may be improved by using a silane coupling agent, a titanium coupling agent and the like.

As the surfactant used for the production of the above polymerized toner particle, an anionic surfactant, a cationic surfactant, an amphoteric surfactant, and a nonionic surfactant can be used.

Here, examples of anionic surfactants include sodium oleate, a fatty acid salt such as castor oil, an alkyl sulfate such as sodium lauryl sulfate, and ammonium lauryl sulfate, an alkylbenzene sulfonate such as sodium dodecylbenzene sulfonate, an alkylnaphthalene sulfonate, an alkylphosphate, a naphthalenesulfonic acid-formalin condensate, and a polyoxyethylene alkyl sulfate. Examples of nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, and an oxyethylene-oxypropylene block polymer. Further, examples of cationic surfactants include alkylamine salts such as laurylamine acetate, and quaternary ammonium salts such as lauryltrimethylammonium chloride and stearyltrimethylammonium chloride. In addition, examples of amphoteric surfactants include an aminocarbonate and an alkylamino acid.

A surfactant like that above can be generally used in an amount within the range of 0.01 to 10% by weight of the polymerizable monomer. Since the used amount of this surfactant affects the dispersion stability of the monomer as well as the environmental dependency of the obtained polymerized toner particles, the surfactant is preferably used in an amount within the above range where the dispersion stability of the monomer is secured, and the environmental dependency of the polymerized toner particles is unlikely to be excessively affected.

For the production of the polymerized toner particles, a polymerization initiator is generally used. Examples of polymerization initiators include water-soluble polymerization initiators and oil-soluble polymerization initiators, and either of them can be used in the present invention. Examples of water-soluble polymerization initiators which can be used in the present invention include persulfate salts such as potassium persulfate and ammonium persulfate, and water-soluble peroxide compounds. Examples of oil-soluble polymerization initiator include azo compounds such as azobisisobutyronitrile, and oil-soluble peroxide compounds.

In the case where a chain-transfer agent is used in the present invention, examples of the chain-transfer agent include mercaptans such as octylmercaptan, dodecylmercaptan and tert-dodecylmercaptan, and carbon tetrabromide.

Further, in the case where the polymerized toner particles used in the present invention contain a fixation improving agent, examples thereof include a natural wax such as carnauba wax, and an olefinic wax such as polypropylene and polyethylene.

In the case where the polymerized toner particles used in the present invention contain a charge control agent, the charge control agent which is used is not especially limited. Examples include a nigrosine dye, a quaternary ammonium salt, an organic metal complex, and a metal-containing monoazo dye.

Examples of the additive used for improving the fluidity etc. of the polymerized toner particles include silica, titanium oxide, barium titanate, fluororesin microparticles and acrylic resin microparticles. These can be used alone or in combination thereof.

Further, examples of the salting-out agent used for separating the polymerized particles from the aqueous medium include metal salts such as magnesium sulfate, aluminum sulfate, barium chloride, magnesium chloride, calcium chloride, and sodium chloride.

The average particle size of the toner particles produced as above is in the range of 2 to 15 μm, and preferably in the range of 3 to 10 μm. Polymerized toner particles have higher uniformity than crushed toner particles. If the toner particles are less than 2 μm, charging capability is reduced, whereby fogging and toner scattering tend to occur. If the toner particles are more than 15 μm, this becomes a factor in deteriorating image quality.

By mixing the thus-produced carrier with a toner, an electrophotographic developer can be obtained. The mixing ratio of the carrier to the toner, namely, the toner concentration, is preferably set to be 3 to 15% by weight. If the concentration is less than 3% by weight, a desired image density is hard to obtain. If the concentration is more than 15% by weight, toner scattering and fogging tend to occur.

A developer obtained by mixing the thus-produced carrier and a toner can be used as a supply developer. In this case, the mixing ratio of the carrier and the toner may be 2 to 50 parts by weight of toner based on 1 part by weight of carrier.

The thus-prepared electrophotographic developer according to the present invention can be used in digital copying machines, printers, FAXs, printing presses and the like, which use a development system in which electrostatic latent images formed on a latent image holder having an organic photoconductor layer are reversal-developed by the magnetic brushes of a two-component developer having the toner and the carrier while impressing a bias electric field. The present developer can also be applied in full-color machines and the like which use an alternating electric field, which is a method that superimposes an AC bias on a DC bias, when the developing bias is applied from magnetic brushes to the electrostatic latent image side.

The present invention will now be described in more detail based on the following examples. However, the present invention is in no way limited to these examples.

Example 1

Raw materials were weighed out in a ratio of 35 mol % of MnO, 14.5 mol % of MgO, 50 mol % of $Fe_2O_3$ and 0.5 mol % of SrO. The resultant mixture was crushed for 5 hours by a dry media mill (vibrating mill using stainless steel beads ⅛ inch in diameter). The resultant crushed matter was turned into a pellet having sides of about 1 mm using a roller compactor. Manganomanganic oxide was used for the MnO raw material, magnesium hydroxide was used for the MgO raw material, and strontium carbonate was used as the SrO raw material. This pellet was passed through a vibrating sieve having 3 mm apertures to remove coarse powder, and then through a vibrating sieve having 0.5 mm apertures to remove fine powder. The resultant pellet was then heated in a rotary electric furnace for 3 hours at 1,050° C. to carry out calcination. Subsequently, the particles were crushed by a dry media mill (vibrating mill using stainless steel beads ⅛ inch in diameter) until the average particle size was 4.1 μm. The particles were then charged with water, and crushed for a further 5 hours by a wet media mill (vertical bead mill using stainless steel beads 1/16 inch in diameter). The particle size (crushed primary particle size) of this slurry was measured using a Microtrac. The results showed that $D_{50}$ was 1.8 μm. The slurry was charged with an appropriate amount of dispersant. To obtain a suitable pore volume, the slurry was also charged with 0.4% by weight of PVA (20% solution) based on solid content as a binder. The slurry was then granulated and dried by a spray drier. The resultant granules (granulated matter) were adjusted for particle size, and then heated in a rotary electric furnace at 700° C. for 2 hours to remove the organic components such as the dispersant and the binder.

Subsequently, the granules were held for 5 hours in a tunnel electric furnace at a sintering temperature of 1,125° C. under a nitrogen atmosphere. At this stage, the rate of temperature increase was 150° C./hour, and the cooling rate was 110° C./hour. Then, the sintered material was crushed and further classified for particle size adjustment. Low magnetic particles were then separated off by magnetic separation to obtain a core material of porous ferrite particles. This ferrite core material had a pore volume of 0.095 mL/g, a peak pore size of 1.41 μm, and pore size unevenness dv of 0.68.

Next, a condensation-crosslinking silicone resin having T units and D units as main components (weight average molecular weight of about 8000) was prepared, and 100 parts by weight of the above-described porous ferrite particles, 60 parts by weight of this silicone resin in solution (since the resin solution concentration was 20%, 12 parts by weight as solid content, with a toluene diluent solvent) and 10% by weight of an aminosilane coupling agent (γ-aminopropyltriethoxysilane) based on the resin solid content were mixed and stirred at 60° C. under a reduced pressure of 2.3 kPa. Then, while volatilizing the toluene, the resin permeated into the porous ferrite core material interior and was filled therein.

Once it was confirmed that the toluene had sufficiently volatilized, the stirring was continued for a further 30 minutes. After the toluene had almost completely been removed, the product was taken out of the apparatus and placed in a vessel. This vessel was then placed in a hot air heating oven, and the product was heat treated for 2 hours at 220° C.

Then, the product was cooled to room temperature, and the ferrite particles having resin which had been cured were removed. Particle agglomerates were broken up using a vibrating sieve with 200 M apertures. Using a magnetic separator, non-magnetic matter was removed. Then, again using the vibrating sieve, coarse particles were removed to obtain resin-filled particles filled with resin.

The surface of the resultant particles was coated using a fluidized bed coater with 0.2% by weight, based on the weight of the particles after filling, of the same silicone resin as the filled resin. At this stage, 10% by weight of an aminosilane coupling agent (γ-aminopropyltrimethoxysilane), based on the coated resin solid content, was added to the coated resin as a charge control agent. After the coating, the particles were heated for 2 hours at 220° C. Then, the particles were cooled to room temperature, and the ferrite particles having resin which had been cured were removed. Particle agglomerates were broken up using a vibrating sieve with 200 M apertures. Using a magnetic separator, non-magnetic matter was removed. Then, again using the vibrating sieve, coarse particles were removed to obtain a resin-filled carrier which had been coated with resin on its surface.

Example 2

A resin-filled carrier having a resin-coated surface was obtained in the same manner as in Example 1, except that 90 parts by weight of the silicone resin solution to be filled (since the resin solution concentration was 20%, 15 parts by weight as solid content) were used.

Example 3

A resin-filled carrier having a resin-coated surface was obtained in the same manner as in Example 1, except that the sintering temperature in the tunnel electric furnace was changed to 1,100° C.

Example 4

A resin-filled carrier having a resin-coated surface was obtained in the same manner as in Example 1, except that the sintering temperature in the tunnel electric furnace was changed to 1,150° C.

Example 5

A resin-filled carrier having a resin-coated surface was obtained in the same manner as in Example 1, except that the sintering temperature in the tunnel electric furnace was changed to 1,100° C., and 90 parts by weight of the silicone resin solution to be filled (since the resin solution concentration was 20%, 18 parts by weight as solid content) were used.

Example 6

A resin-filled carrier having a resin-coated surface was obtained in the same manner as in Example 1, except that the sintering temperature in the tunnel electric furnace was changed to 1,150° C., and 35 parts by weight of the silicone resin solution to be filled (since the resin solution concentration was 20%, 7 parts by weight as solid content) were used.

Example 7

A resin-filled carrier having a resin-coated surface was obtained in the same manner as in Example 1, except that the sintering temperature in the tunnel electric furnace was changed to 1,170° C., and 30 parts by weight of the silicone resin solution to be filled (since the resin solution concentration was 20%, 6 parts by weight as solid content) were used.

Comparative Example 1

A core material of porous ferrite particles was obtained in the same manner as in Example 1 except for the following. The organic components in the granulated matter obtained by a spray dryer in the same manner as in Example 1 were removed using a rotary electric furnace. Then, using a tunnel electric furnace, sintering was carried out at 1,050° C. under an air atmosphere. Then, again using a tunnel electric furnace, sintering was carried out at a sintering temperature of 1,180° C. under a nitrogen gas atmosphere.

Subsequently, a resin-filled carrier having a resin-coated surface was obtained in the same manner as in Example 1, except that 25 parts by weight of the silicone resin solution to be filled (since the resin solution concentration was 20%, 5 parts by weight as solid content) were used.

Comparative Example 2

A resin-filled carrier having a resin-coated surface was obtained in the same manner as in Example 1, except that the crushing after calcination was only carried out for 0.5 hours by a wet ball mill using stainless steel beads ⅛ inch in diameter, the sintering temperature in the tunnel electric furnace was 1,050° C. (rate of temperature increase 180° C., rate of cooling 160° C.), and 95 parts by weight of the silicone resin solution to be filled (since the resin solution concentration was 20%, 19 parts by weight as solid content) were used.

Comparative Example 3

A core material of porous ferrite particles was obtained in the same manner as in Example 1 except for the following. The organic components in the granulated matter obtained by a spray dryer in the same manner as in Example 1 were removed using a rotary electric furnace. Then, using a tunnel electric furnace, sintering was carried out at 1,050° C. under an air atmosphere. Then, again using a tunnel electric furnace, sintering was carried out at a sintering temperature of 1,190° C. under a nitrogen gas atmosphere.

Subsequently, a resin-filled carrier having a resin-coated surface was obtained in the same manner as in Example 1, except that 20 parts by weight of the silicone resin solution to be filled (since the resin solution concentration was 20%, 4 parts by weight as solid content) were used.

The pore volume, peak pore size, pore size unevenness dv, and resin filled amount of Examples 1 to 7 and Comparative Examples 1 to 3 are shown in Table 1. Further, the respective properties and evaluation results of the obtained resin-filled carriers are shown in Table 2.

TABLE 1

| | Pore volume (ml/g) | Core material pore size: Peak pore size (μm) | d16 (μm) | d84 (μm) | Pore size unevenness dv | Resin filled amount (parts by weight) |
|---|---|---|---|---|---|---|
| Example 1 | 0.095 | 1.41 | 2.41 | 1.06 | 0.68 | 12 |
| Example 2 | 0.095 | 1.41 | 2.41 | 1.06 | 0.68 | 15 |
| Example 3 | 0.122 | 1.47 | 2.75 | 1.15 | 0.80 | 12 |
| Example 4 | 0.066 | 1.26 | 2.12 | 0.96 | 0.58 | 12 |
| Example 5 | 0.122 | 1.47 | 2.75 | 1.15 | 0.80 | 18 |
| Example 6 | 0.066 | 1.26 | 2.12 | 0.96 | 0.58 | 7 |
| Example 7 | 0.040 | 1.18 | 2.03 | 0.90 | 0.57 | 6 |
| Comparative Example 1 | 0.043 | 0.80 | 2.10 | 0.24 | 0.93 | 5 |
| Comparative Example 2 | 0.195 | 1.70 | 3.53 | 1.17 | 1.18 | 19 |
| Comparative Example 3 | 0.028 | 0.78 | 2.00 | 0.18 | 0.91 | 4 |

TABLE 2

| | Charge amount (μC/g): 3 min | 30 min | Charge amount startup speed (%) | Charge fluctuation: Charge after strong stirring (μC/g) | Percentage change in charge after strong stirring (%) | SEM observation results (particle shape and agglomeration degree) | Carrier pyconometer density (g/cm³) | Carrier apparent density (g/cm³) | Carrier average particle size d50(μm) | Carrier saturated magnetization (Am²/kg) |
|---|---|---|---|---|---|---|---|---|---|---|
| Example 1 | 21.8 | 21.8 | 100.0 | 21.5 | 98.6 | ◎ | 3.86 | 1.70 | 38.63 | 63 |
| Example 2 | 28.2 | 29.2 | 96.6 | 28.0 | 95.9 | ◎ | 3.52 | 1.59 | 39.64 | 62 |
| Example 3 | 20.4 | 22.4 | 91.1 | 20.8 | 92.9 | ○ | 3.80 | 1.66 | 38.35 | 64 |
| Example 4 | 25.8 | 30.8 | 83.8 | 28.0 | 90.9 | ◎ | 3.82 | 1.56 | 39.41 | 63 |
| Example 5 | 29.0 | 33.2 | 87.3 | 29.6 | 89.2 | ○ | 3.48 | 1.47 | 39.10 | 61 |
| Example 6 | 21.0 | 25.6 | 82.0 | 22.7 | 88.7 | ○ | 4.14 | 1.78 | 38.17 | 66 |
| Example 7 | 21.1 | 25.9 | 81.5 | 21.0 | 81.1 | ○ | 4.18 | 1.81 | 39.13 | 68 |
| Comparative example 1 | 17.6 | 24.2 | 72.7 | 18.0 | 74.4 | Δ | 4.20 | 1.86 | 38.03 | 69 |

TABLE 2-continued

| | Charge amount (μC/g) | | Charge amount startup speed | Charge fluctuation: Charge after strong stirring | Charge fluctuation: Percentage change in charge after strong stirring | SEM observation results (particle shape and agglomeration | Carrier pyconometer density | Carrier apparent density | Carrier average particle size | Carrier saturated magnetization |
|---|---|---|---|---|---|---|---|---|---|---|
| | 3 min | 30 min | (%) | (μC/g) | (%) | degree) | (g/cm$^3$) | (g/cm$^3$) | d50(μm) | (Am$^2$/kg) |
| Comparative example 2 | 15.4 | 18.0 | 85.6 | 11.4 | 63.3 | X | 3.46 | 1.32 | 42.83 | 60 |
| Comparative example 3 | 15.0 | 23.9 | 62.8 | 16.5 | 69.0 | X | 4.38 | 1.91 | 39.24 | 70 |

(Evaluation)

It is clear from the results shown in Table 2 that the resin-filled carriers described in Examples 1 to 7 could obtain good results with a rapid charge startup speed and, since there were not many deformed particles or agglomerated particles, suppressed charge fluctuation, due to the fact that a core material which kept a suitable pore volume, peak pore size, and pore size unevenness dv was used, and as a result of the fact that the filling of the resin was carried out sufficiently but not in excess.

In view of these results, the resin-filled carriers described in Examples 1 to 7 have realized a reduced specific gravity, while simultaneously keeping good charge properties. Therefore, if these carriers were actually used in a developer, it can be easily imagined that the charge amount would rapidly startup even during toner supply, charge fluctuation would be small even during printing, and that good image quality free from image defects such as toner scattering and fogging could be obtained over a long period of time. Further, it can be expected that these resin-filled carriers could also be preferably used as a supply developer.

On the other hand, the carriers described in Comparative Examples 1 to 3 have a pore volume, a peak pore size, and a pore size unevenness dv which are not in the suitable range, so that the evaluation results concerning charge startup speed and charge fluctuation were poor.

As described above, if the carriers obtained in Comparative Examples 1 to 3 were actually used, it can be easily imagined that image defects such as toner scattering and fogging would be caused due to the charge amount not starting up rapidly during toner supply, and that the charge amount would markedly fluctuate due to particles which had agglomerated breaking up from the stress in an actual machine, and the particles themselves breaking apart, which would promote image defects such as toner scattering and fogging, and make it impossible to stably maintain good image quality.

Since the resin-filled carrier for an electrophotographic developer according to the present invention is a resin-filled ferrite carrier, and since it is lighter due to a low true density, a longer life with excellent durability can be achieved, and yet the inventive resin-filled carrier is stronger than a magnetic powder-dispersed carrier, and does not split, deform or melt from heat or shocks. Further, since the inventive resin-filled carrier has a specific pore size and pore volume, charge startup properties are rapid, and charge fluctuation during printing is not caused.

Therefore, the resin-filled carrier for an electrophotographic developer according to the present invention can be widely used in the fields of full color machines in which high quality images are demanded, as well as high-speed printers in which the reliability and durability of image sustainability are demanded.

What is claimed is:

1. A resin-filled carrier for an electrophotographic developer obtained by filling resin into voids of a porous ferrite core material, wherein the porous ferrite core material has a pore volume of 0.04 to 0.16 mL/g and a peak pore size of 0.9 to 2.0 μm.

2. The resin-filled carrier for an electrophotographic developer according to claim 1, wherein in the pore size distribution of the porous ferrite core material, pore size unevenness dv represented by the following formula (1) is 1.5 or less, $$dv=|d_{84}-d_{16}|/2 \quad (1)$$

wherein $d_{16}$ is a pore size calculated from the applied pressure on mercury when the mercury pressure penetration reaches 16%, where the total pressure penetration in the high pressure region is 100%; and $d_{84}$ is a pore size calculated from the applied pressure on mercury when the mercury pressure penetration reaches 84%, in which the total pressure penetration in the high pressure region is 100%.

3. The resin-filled carrier for an electrophotographic developer according to claim 1, wherein the resin is filled in the porous ferrite core material in an amount of 6 to 30 parts by weight based on 100 parts by weight of the porous ferrite core material.

4. The resin-filled carrier for an electrophotographic developer according to claim 1, having an average particle size of 20 to 60 μm.

5. The resin-filled carrier for an electrophotographic developer according to claim 1, having a saturated magnetization of 30 to 80 Am$^2$/kg.

6. The resin-filled carrier for an electrophotographic developer according to claim 1, having a pyconometer density of 2.5 to 4.5 g/cm$^3$.

7. The resin-filled carrier for an electrophotographic developer according to claim 1, having an apparent density of 1.0 to 2.5 g/cm$^3$.

8. An electrophotographic developer comprising the resin-filled carrier according to claim 1 and a toner.

9. The electrophotographic developer according to claim 8, which is a supply developer.

10. An electrophotographic developer comprising the resin-filled carrier according to claim 2 and a toner.

11. An electrophotographic developer comprising the resin-filled carrier according to claim 3 and a toner.

12. An electrophotographic developer comprising the resin-filled carrier according to claim 4 and a toner.

13. An electrophotographic developer comprising the resin-filled carrier according to claim 5 and a toner.

14. An electrophotographic developer comprising the resin-filled carrier according to claim 6 and a toner.

15. An electrophotographic developer comprising the resin-filled carrier according to claim 7 and a toner.

16. The electrophotographic developer according to claim 10, which is a supply developer.

17. The electrophotographic developer according to claim 11, which is a supply developer.

18. The electrophotographic developer according to claim 12, which is a supply developer.

19. The electrophotographic developer according to claim 13, which is a supply developer.

20. The electrophotographic developer according to claim 14, which is a supply developer.

* * * * *